US005617905A

United States Patent [19]

Ziegler

[11] Patent Number: 5,617,905

[45] Date of Patent: Apr. 8, 1997

[54] CIRCULAR-WEAVING MACHINE WITH VERTICALLY MOVING HEDDLES

[75] Inventor: Josef Ziegler, Arrach, Germany

[73] Assignee: RMB, Cham, Germany

[21] Appl. No.: 335,666

[22] Filed: Nov. 8, 1994

Related U.S. Application Data

[63] Continuation of Ser. No. 198,209, Feb. 17, 1994, abandoned, which is a continuation of Ser. No. 960,454, filed as PCT/EP92/00863 Apr. 17, 1992, published as WO92/18675 Oct. 29, 1992, abandoned.

[30] Foreign Application Priority Data

Apr. 19, 1991 [DE] Germany ..... 41 12 770.6

[51] Int. Cl.[6] ..... D03D 37/00

[52] U.S. Cl. ..... 139/459; 139/353

[58] Field of Search ..... 139/457, 353, 139/459, 15

[56] References Cited

U.S. PATENT DOCUMENTS 4,355,666 10/1982 Toril ..... 139/457 X
4,509,562 4/1985 Schonberger et al. ..... 139/457 X
4,977,933 12/1990 Brais ..... 139/459

FOREIGN PATENT DOCUMENTS 766922 10/1971 Belgium .
0396407 11/1990 European Pat. Off. .
103258 11/1897 Germany .
1300464 12/1972 United Kingdom .
2055908 3/1981 United Kingdom .
2123857 2/1984 United Kingdom ..... 139/457

*Primary Examiner*—Andy Falik
*Attorney, Agent, or Firm*—Bryan Cave LLP

[57] ABSTRACT

A circular loom for the manufacture of tubular fabrics having an annular frame with an upper annular plate and a lower annular plate, both having bearing bores for vertically moving healds (heddles) guiding the warp threads of the hose to be manufactured. Said healds are arranged on the periphery of said frame and are mounted on at least one continuous circular path such that they may be individually vertically displaced. For this purpose, the lower ends of the healds arranged in each circular path have cam following rollers running on a rotary driven cam-like control ring. More than one set of healds (with corresponding rotary driven control rings) along additional circular paths may be used.

26 Claims, 6 Drawing Sheets

54
18
48
transition 62
60
58
56
52
54
46
18
50
16
48
rising
Va

CIRCULAR-WEAVING MACHINE WITH VERTICALLY MOVING HEDDLES

RELATED APPLICATIONS

This application is a continuation of U.S. pat. appln. Ser. No. 08/198,209, filed Feb. 17, 1994, now abandoned, which is a continuation of U.S. pat. appln. Ser. No. 07/960,454, filed Feb. 12, 1993, now abandoned, which is based on PCT appln. No. PCT/EP92/00863, filed Apr. 17, 1992.

BACKGROUND OF THE INVENTION

The invention relates to a circular loom for producing hoses, consisting of an annular frame on the periphery of which are arranged vertically moveable healds for the warp threads and within which there is mounted at least one rotatable shuttle that carries a weft bobbin.

Such circular looms are generally used to produce fire hoses or industrial tubes. In these looms, it is customary to group the healds for the warp threads in sheds, whereby each partition is movably mounted on guide-rods. If, for example, twelve partitions or sheds are arranged on the periphery, this will result in a hose that has 12 transition corners where the division line shows irregularities.

In addition to circular looms that have healds arranged in partitions, there are also circular looms known in which a control wheel raises and lowers the warp threads and rotates in front of the shuttle. However, with this system errors in the weave are common since the warp threads can slough off. Moreover, since in this case there is only a small lifting distance available, the remainder of the lifting motion must be performed via a shuttle lift. This results in considerable friction, so that with high rotational speeds special cooling measures are required.

The object of invention is to provide a circular loom of the type outlined in the beginning, in which simple measures result in a consistent drawing-in, so that the spacing is uniform over the periphery.

SUMMARY OF THE INVENTION

The object is achieved in a circular loom of this type in accordance with the invention, in that the healds are mounted on at least one circular path at a constant distance apart and so as to be individually vertically displaceable, a rotary control disc being provided for height control of the healds on the circular path.

A solution of this type, which can be achieved using constructionally simple means, avoids the disadvantages previously mentioned, and thus a tube can be produced with uniform spacing and without transition points on the periphery.

In order to produce various types of weave, a plurality of concentric circular paths of healds with associated control discs can be provided. The number of control discs corresponds to the number of shuttles and hence the number of weft threads. In order to produce a linen weave, two or four control discs are provided, whilst a twill weave can be produced using three control discs.

As a further development of the invention, the healds are mounted to be height-adjustable in bearing bores provided in an upper annular plate and a lower annular plate which are part of the annular frame. The lower ends of the healds carry cam-following rollers running on the control discs.

In accordance with a further feature of the invention, each shuttle has a shuttle hand comprising a single-part round rod and rising in the opposite direction to the direction of rotation.

In accordance with a further feature of the invention each shuttle has a planar and substantially triangular weaving blade which at its tip pointing towards the rotational axis of the loom has a recess shaped as part of a circle and a nose guiding the weft thread.

In order to interrupt the weaving process if the thread breaks, annular thread-guiding rods are attached to the outer periphery of the frame and are positioned prior to the healds in the direction of feed of the warp threads, and a tension member is provided for each warp thread between two thread-guiding rods, and the lower freely suspended end of the said tension member has a switching member to switch off the machine in the event of the thread breaking, for example by shutting off the electricity supply.

In order to specify the quality of the tube for production, it was previously conventional to control the sett of the weft manually. A substantial improvement to this method of proceeding is achieved in accordance with a further feature of the invention, by means of an electronic control unit with a computer to which there are connected an input unit and an indicator unit for the sett of the weft, an input unit and an indicator unit for the rotational speed of the shuttle, with an associated tachometer, and a sensor to measure and indicate the length of tube produced per unit of time.

BRIEF DESCRIPTION OF THE DRAWINGS

The invention will subsequently be described with reference to one embodiment shown in the drawings.

DESCRIPTION OF THE PREFERRED EMBODIMENT

Figure 1:
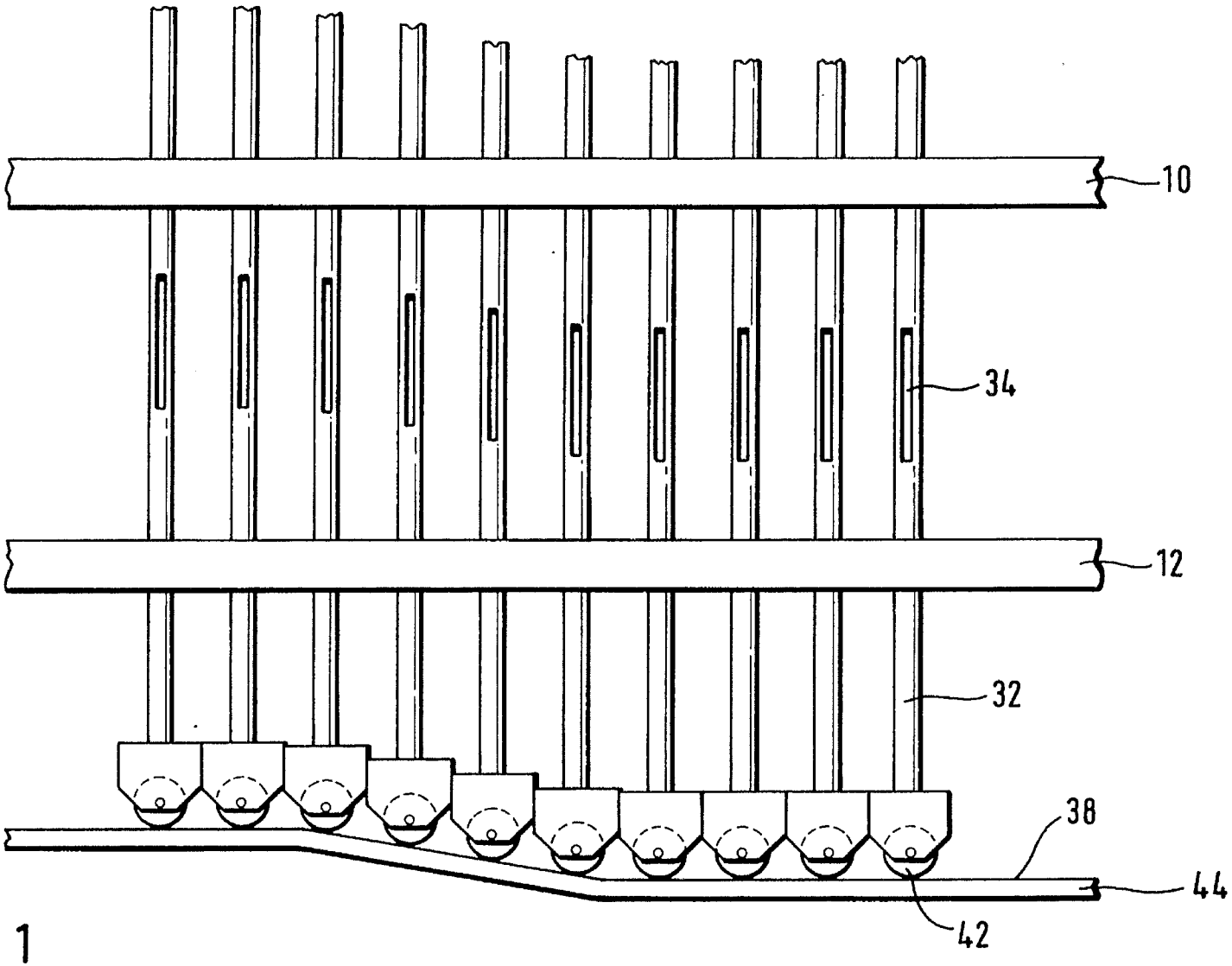
FIG. 1 is a schematic side view of a part of the circular loom of the invention, to show the arrangement of the healds and the associated control disc.
Figure 2:
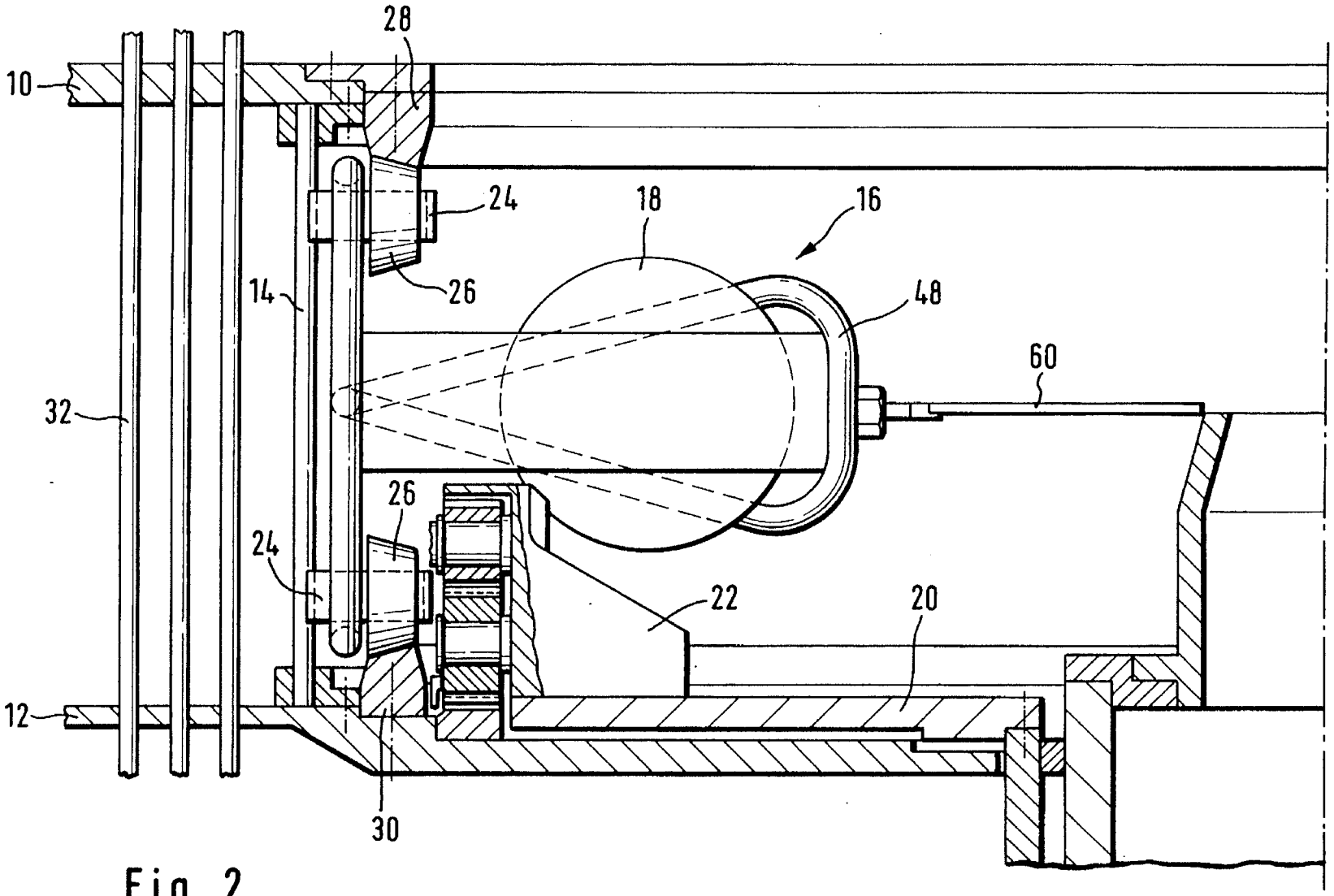
FIG. 2 is a vertical section through a part of the circular loom with a heald ring.
Figure 3:
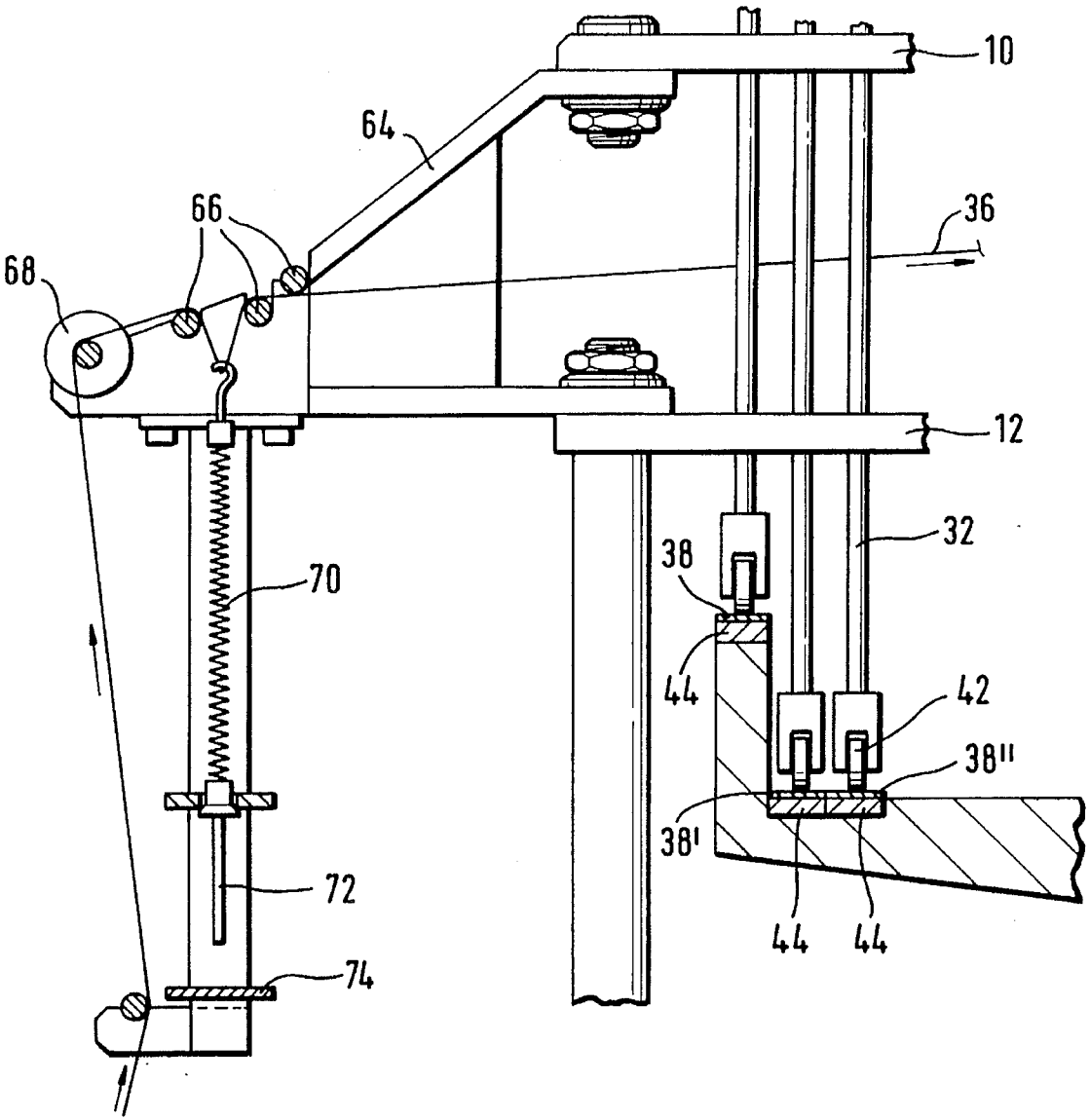
FIG. 3 is a vertical section which is radially further outwards with regard to FIG. 2, with three heald rings.
Figure 4:
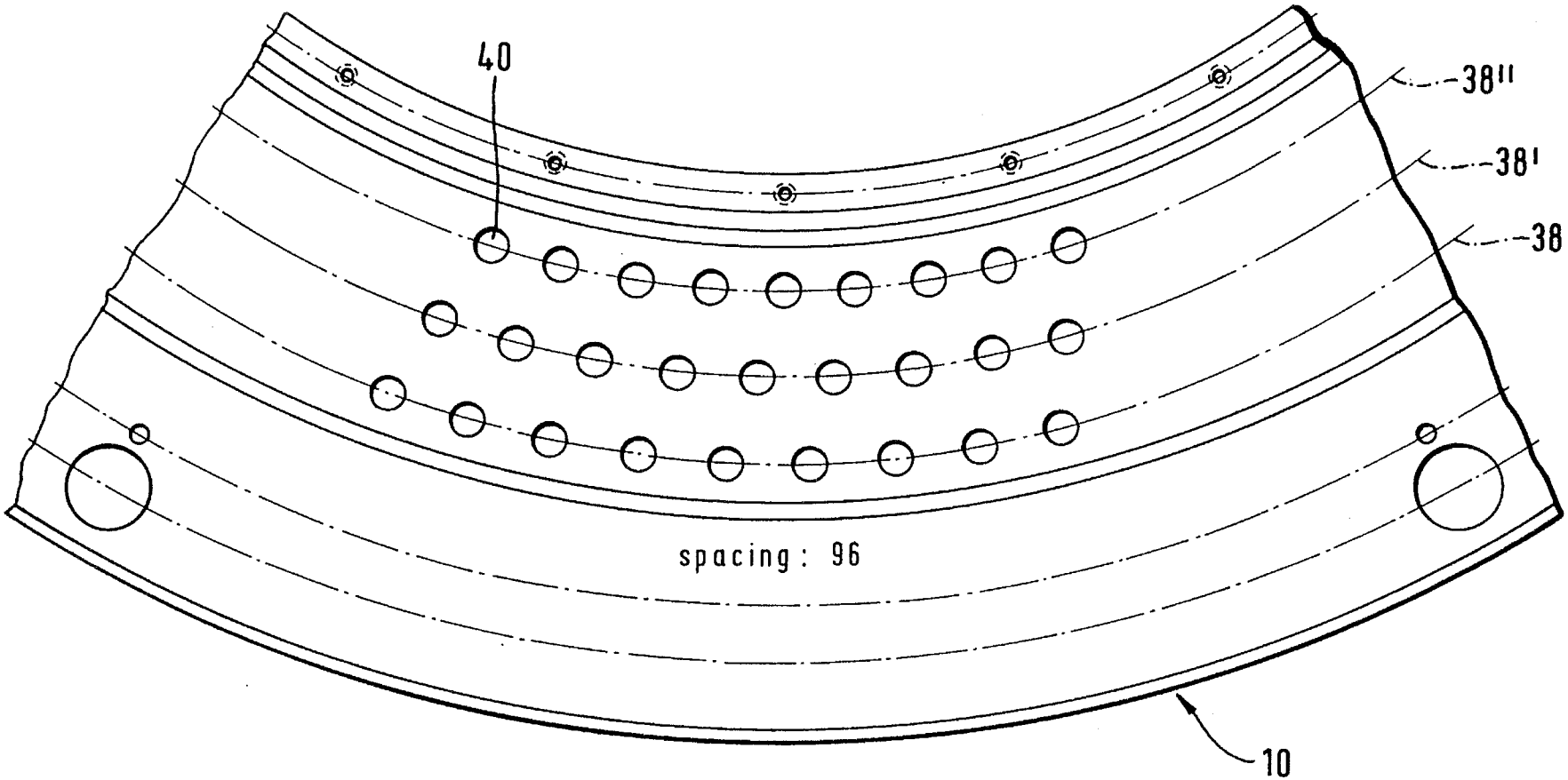
FIG. 4 is a plan view of a part of the upper annular plate.
Figures 5, 5A:
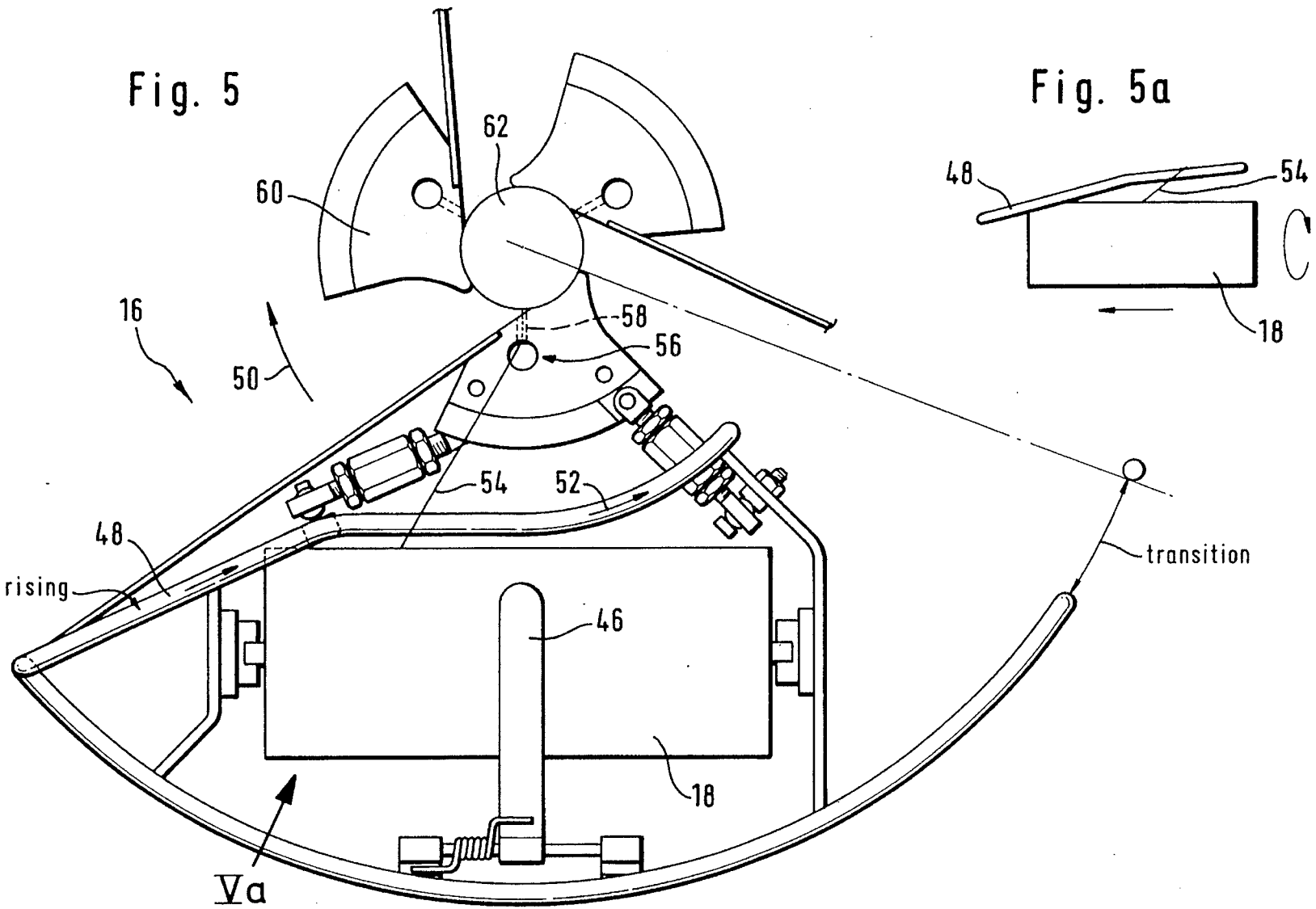
FIG. 5 is an enlarged plan view of a shuttle.
FIG. 5A is a detail elevational view of shuttle hand 48 and weft bobbin 18 in FIG. 5.

The circular loom of the invention shown in FIGS. 1 to 5 is used to produce tubes, for example fire hoses or tubes for industrial purposes, and has an annular frame with an upper annular plate 10 and a lower annular plate 12. As FIG. 2 shows, the two annular plates 10 and 12 are interconnected by a reed or a cage 14, used to guide and absorb the horizontal forces of at least one shuttle 16 (FIG. 5). The shuttle 16 carries a weft bobbin 18 and is caused to rotate by a rotating push disc 20, via a push arm 22. The horizontal forces are absorbed by the cage 14 via toothed supporting rollers 24, while the vertical forces are transferred by support rollers 26 to an upper guideway 28 and a lower guideway 30. The upper guideway 28 is secured to the upper annular plate 10, whilst the lower guideway 30 is attached to the lower annular plate 12.

Rod-shaped healds 32 are used to raise and lower the warp threads, each heald having an elongate hole 34 through which the associated warp thread 36 is guided. The healds 32 are arranged to be equidistant on an associated circular path 38 (or 38', 38"), the paths being concentric as shown by FIG. 4. Bearing bores 40 are used for height-adjustable mounting of the healds 32, and are provided in the upper annular plate 10 and the lower annular plate 12 to correspond to the circular paths 38, or 38', 38". The lower ends of the healds 32 carry cam-following rollers 42. The cam-following rollers 42 of all the healds 32 of one circular path 38 or 38', 38" run on an associated rotary control disc 44, which raises or lowers the healds 32 in the required way.

As FIG. 3 shows, three control discs 44 are provided in total, corresponding to the three circular paths 38, 38' and 38", in order to control the vertical movement of the three heald rings.

To correspond to the three control discs 44 and thus the three heald rings, three shuttles 16 are also provided, each carrying a weft bobbin 18, rotational movement of which is slowed by a weft-bobbin brake 46. Each shuttle 16 has a shuttle hand 48, comprising a single-part round rod, rising (arrow 52) in front of the weft bobbin 18 in the opposite direction to the direction of shuttle rotation according to the arrow 50 in FIG. 5, so that the associated weft thread 54 is thereby raised. A nose 56 is used to guide the weft threads 54, the nose having a guide groove 58 extending radially and located on the front edge of a weaving blade 60 which is part of the shuttle 16. FIG. 5 illustrates that the front edges of the triangular weaving blades 16—three of which are provided—are each formed as a recess shaped as part of a circle, and thus a circular opening 62 is formed, through which the tube is drawn off downwardly upon manufacture. The arcuate arrow in FIG. 5A shows the direction of rotation of weft bobbin 18 as weft thread 54 unwinds from weft bobbin 18 and rides on the vertically rising top surface of shuttle hand 48. The straight arrow in FIG. 5A shows the direction of shuttle rotation (as does arrow 50 in FIG. 5).

FIG. 3 shows that a supporting member 64 projecting outwardly is attached to the upper annular plate 10 and the lower annular plate 12, annular thread-guiding rods 66 being secured to the supporting member. The warp threads 36 are guided via the concentrically arranged thread-guiding rods 66, and a braking disc 68 is provided for each warp thread 36, radially outside the thread-guiding rods 66. A tension member 70 is provided for each warp thread 36 between two thread guiding rods 66, and the upper end of the tension member is suspended on the warp thread 36, while the lower, freely suspended end carries a switching member 72 which closes a contact 74 if the thread breaks and thereby switches off the machine.

Figure 6:
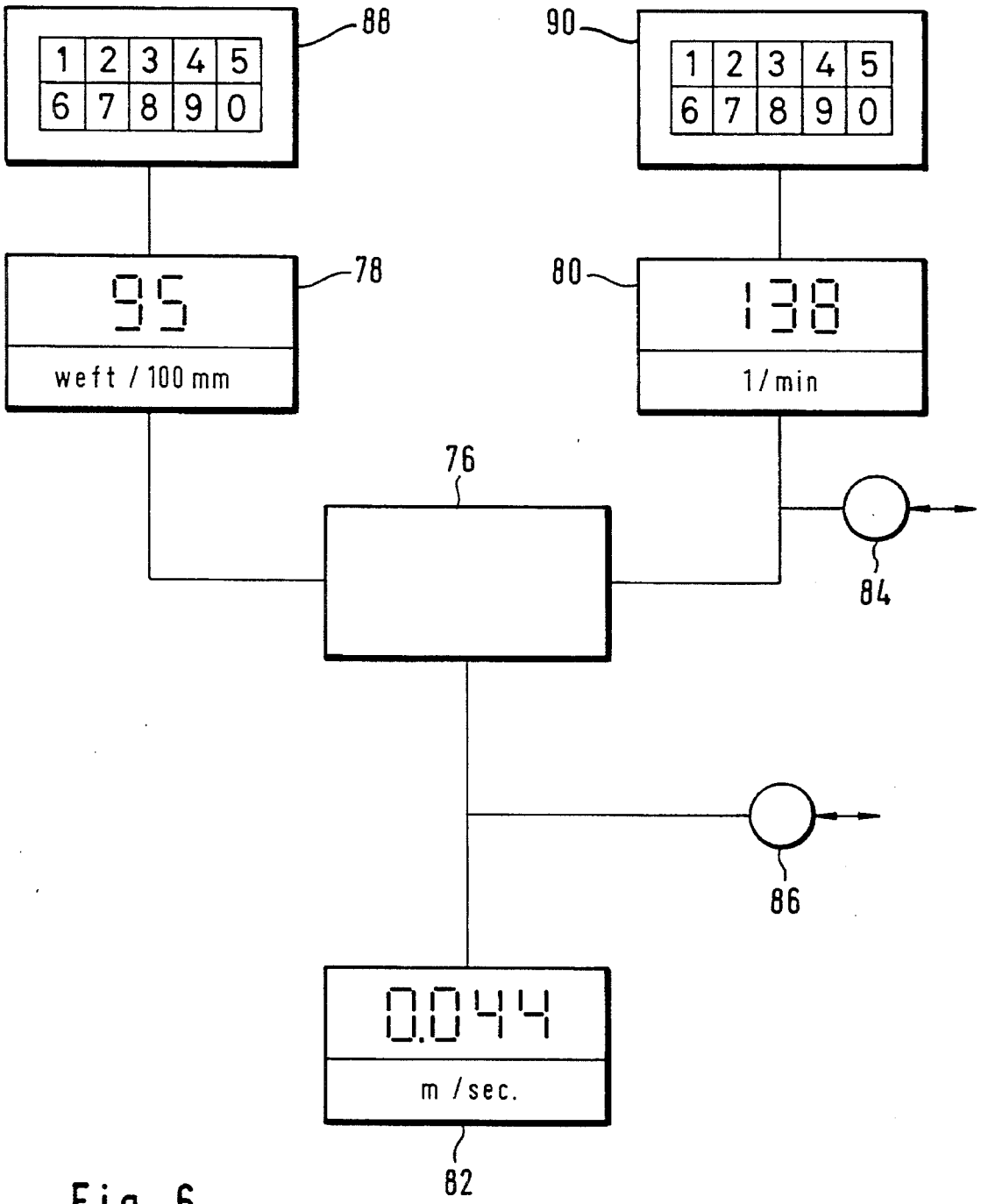
FIG. 6 is a schematic circuit diagram of the control unit for the circular loom of the invention.

FIG. 6 shows an electronic control unit for the circular loom of the invention. Three indicator units 78, 80 and 82 are connected to a computer 76, the indicator unit 78 showing the set of the weft, the unit 80 showing the rotational speed and the unit 82 showing the machine output in m/sec. The rotational speed of the shuttle is measured by a sensor 84, whilst the output of the machine, i.e. the speed at which the finished tube is drawn off, is measured by a sensor 86.

The indicator unit 78 for the set of the weft is connected to an input unit 88, and the indicator unit 80 for the rotational speed is connected to a corresponding input unit 90.

In order to pre-set the quality of the tube and hence the sett of the weft (95 weft threads per 100 mm length of tube, in the example in FIG. 6) the corresponding number of shots (threads) is entered into the input unit 88, while the maximum rotational speed of the shuttle can be specified using the input unit 90. The output is continuously measured by the sensor 86, and the rotational speed is controlled in accordance with the required set of the weft.

I claim:

1. A circular loom which during operation can produce tubes having warp threads (36) and weft threads (54), the weft threads having a set, the loom comprising: (a) an annular frame having an outer periphery, a rotational axis, an upper annular plate (10), and a lower annular plate (12), (b) at least one continuous circular path (38), (c) healds (32) for the warp threads (36), the healds having lower ends, (d) at least one rotary driven control disc means (44) corresponding to the continuous circular path (38), (e) heald control means for vertically displacing the healds comprising cam-following roller means (42) and the at least one rotary driven control disc means (44), and (f) at least one rotatably mounted shuttle (16) having a weft bobbin (18), each annular plate (10, 12) having bearing bores (40) corresponding to the healds (32) and in which bores (40) the healds are vertically displaceable; wherein the healds (32) are mounted in the frame and arranged on the at least one continuous circular path (38) at a constant distance apart and which healds (32) by means of the heald control means are individually vertically displaceable in the bearing bores (40), the lower ends of the healds being connected to the cam-following roller means (42), said cam-following rollers means (42) running on the at least one rotary driven control disc means (44) for vertically displacing the healds (32).

2. A circular loom in accordance with claim 1 further comprising (a) annular thread-guiding rod means (66) for guiding the warp threads (36) and being attached to the outer periphery of the annular frame, the annular thread-guiding rod means (66) being positioned prior to the healds (32) in the direction of feed of the warp threads (36), and (b) a tension member (70) for each warp thread (36), each tension member being connected to switching member means (72) for halting operation of the circular loom in the event of the breakage of the corresponding warp thread (36).

3. The circular loom of claim 2 wherein each tension member (70) has a lower freely suspended end that is connected to the switching member means (72) and wherein each tension member is positioned between two thread-guiding rod means (66).

4. A circular loom in accordance with claim 1 having an electric control unit with a computer (76) to which the following are operatively connected: (a) an input unit (88) and an indicator unit (78) for the set of the weft threads (54), (b) an input unit (90) and an indicator unit (80) for the rotational speed of the shuttle (16), and (c) an indicator unit (82) and a sensor (86) to measure and indicate the amount of tube produced per unit of time.

5. A circular loom in accordance with claim 1 wherein each shuttle (16) has a shuttle hand (48), a portion of which shuttle hand (48) is slanted upwardly in the direction opposite to the direction of rotation of the shuttle (16) during operation of the circular loom.

6. A circular loom in accordance with claim 5 further comprising (a) annular thread-guiding rod means (66) for guiding the warp threads (36) and being attached to the outer periphery of the annular frame, the annular thread-guiding rod means (66) being positioned prior to the healds (32) in the direction of feed of the warp threads (36), and (b) a tension member (70) for each warp thread (36), each tension member being connected to switching member means (72) for halting operation of the circular loom in the event of the breakage of the corresponding warp thread (36).

7. The circular loom of claim 6 wherein each tension member (70) has a lower freely suspended end that is connected to the switching member means (72) and wherein each tension member is positioned between two thread-guiding rod means (66).

8. A circular loom in accordance with claim 5 having an electric control unit with a computer (76) to which the following are operatively connected: (a) an input unit (88) and an indicator unit (78) for the set of the weft threads (54), (b) an input unit (90) and an indicator unit (80) for the rotational speed of the shuttle (16), and (c) an indicator unit (82) and a sensor (86) to measure and indicate the amount of tube produced per unit of time.

9. The circular loom of claim 5 wherein the shuttle hand (48) comprises a single-part round rod.

10. A circular loom in accordance with claim 5 wherein each shuttle (16) has a planar and substantially triangular blade (60) having a tip pointing towards the rotational axis, the blade (60) at its tip having a recess shaped as part of a circle and nose means (56) for guiding the weft threads (54) during operation of the circular loom.

11. A circular loom in accordance with claim 10 further comprising (a) annular thread-guiding rod means (66) for guiding warp threads (36) and being attached to the outer periphery of the annular frame, the annular thread-guiding rod means (66) being positioned prior to the healds (32) in the direction of feed of the warp threads (36), and (b) a tension member (70) for each warp thread (36), each tension member being connected to switching member means (72) for halting operation of the circular loom in the event of the breakage of the corresponding warp thread (36).

12. The circular loom of claim 11 wherein each tension member (70) has a lower freely suspended end that is connected to the switching member means (72) and wherein each tension member is positioned between two thread-guiding rod means (66).

13. A circular loom in accordance with claim 10 having an electric control unit with a computer (76) to which the following are operatively connected: (a) an input unit (88) and an indicator unit (78) for the set of the weft threads (54), (b) an input unit (90) and an indicator unit (80) for the rotational speed of the shuttle (16), and (c) an indicator unit (82) and a sensor (86) to measure and indicate the amount of tube produced per unit of time.

14. A circular loom in accordance with claim 1 having the healds (32) arranged in a plurality of concentric continuous circular paths (38, 38' 38") and a plurality of the rotary driven control disc means (44), one rotary driven control disc means (44) corresponding to each circular path (38, 38', 38").

15. A circular loom in accordance with claim 14 further comprising (a) annular thread-guiding rod means (66) for guiding warp threads (36) and being attached to the outer periphery of the annular frame, the annular thread-guiding rod means (66) being positioned prior to the healds (32) in the direction of feed of the warp threads (36), and (b) a tension member (70) for each warp thread (36), each tension member being connected to switching member means (72) for halting operation of the circular loom in the event of the breakage of the corresponding warp thread (36).

16. The circular loom of claim 15 wherein each tension member (70) has a lower freely suspended end that is connected to the switching member means (72) and wherein each tension member is positioned between two thread-guiding rod means (66).

17. A circular loom in accordance with claim 14 having an electric control unit with a computer (76) to which the following are operatively connected: (a) an input unit (88) and an indicator unit (78) for the set of the weft threads (54), (b) an input unit (90) and an indicator unit (80) for the rotational speed of the shuttle (16), and (c) an indicator unit (82) and a sensor (86) to measure and indicate the amount of tube produced per unit of time.

18. A circular loom in accordance with claim 14 wherein each shuttle (16) has a shuttle hand (48), a portion of which shuttle hand (48) is slanted upwardly in the direction opposite to the direction of rotation of the shuttle (16) during operation of the circular loom.

19. A circular loom in accordance with claim 18 further comprising (a) annular thread-guiding rod means (66) for guiding warp threads (36) and being attached to the outer periphery of the annular frame, the annular thread-guiding rod means (66) being positioned prior to the healds (32) in the direction of feed of the warp threads (36), and (b) a tension member (70) for each warp thread (36), each tension member being connected to switching member means (72) for halting operation of the circular loom in the event of the breakage of the corresponding warp thread (36).

20. The circular loom of claim 19 wherein each tension member (70) has a lower freely suspended end that is connected to the switching member means (72) and wherein each tension member is positioned between two thread-guiding rod means (66).

21. A circular loom in accordance with claim 18 having an electric control unit with a computer (76) to which the following are operatively connected: (a) an input unit (88) and an indicator unit (78) for the set of the weft threads (54), (b) an input unit (90) and an indicator unit (80) for the rotational speed of the shuttle (16), and (c) an indicator unit (82) and a sensor (86) to measure and indicate the amount of tube produced per unit of time.

22. The circular loom of claim 18 wherein the shuttle hand (48) comprises a single-part round rod.

23. A circular loom in accordance with claim 18 wherein each shuttle (16) has a planar and substantially triangular blade (60) having a tip pointing towards the rotational axis, the blade (60) at its tip having a recess shaped as part of a circle and nose means (56) for guiding the weft threads (54) during operation of the circular loom.

24. A circular loom in accordance with claim 23 further comprising (a) annular thread-guiding rod means (66) for guiding warp threads (36) and being attached to the outer periphery of the annular frame, the annular thread-guiding rod means (66) being positioned prior to the healds (32) in the direction of feed of the warp threads (36), and (b) a tension member (70) for each warp thread (36), each tension member being connected to switching member means (72) for halting operation of the circular loom in the event of the breakage of the corresponding warp thread (36).

25. The circular loom of claim 24 wherein each tension member (70) has a lower freely suspended end that is connected to the switching member means (72) and wherein each tension member is positioned between two thread-guiding rod means (66).

26. A circular loom in accordance with claim 23 having an electric control unit with a computer (76) to which the following are operatively connected: (a) an input unit (88) and an indicator unit (78) for the set of the weft threads (54), (b) an input unit (90) and an indicator unit (80) for the rotational speed of the shuttle (16), and (c) an indicator unit (82) and a sensor (86) to measure and indicate the amount of tube produced per unit of time.

* * * * *